United States Patent [19]

Miller

[11] 4,022,038

[45] May 10, 1977

[54] MAGNETICALLY OPERATED LOCKING DEVICE AND KEY

[75] Inventor: Albert J. Miller, Santa Clara, Calif.

[73] Assignee: Engineering Systems Corporation, Santa Clara, Calif.

[22] Filed: Feb. 20, 1976

[21] Appl. No.: 659,843

[52] U.S. Cl. ..... 70/276; 70/363; 70/413

[51] Int. Cl.[2] ..... E05B 47/00

[58] Field of Search ..... 70/276, 413, 363, 55, 70/449, 450, DIG. 40, DIG. 56

[56] References Cited

UNITED STATES PATENTS

| | | | |
|---|---|---|---|
| 3,111,834 | 11/1963 | Felson | 70/276 |
| 3,234,767 | 2/1966 | Allander | 70/413 X |
| 3,421,348 | 1/1969 | Hallmann | 70/276 |
| 3,584,484 | 6/1971 | Hallmann | 70/276 |
| 3,606,776 | 9/1971 | Drach | 70/276 |
| 3,654,782 | 4/1972 | Heimann | 70/276 |
| 3,680,336 | 8/1972 | Schendel | 70/276 |
| 3,744,833 | 7/1973 | Berducone | 70/276 X |
| 3,837,195 | 9/1974 | Pelto | 70/276 |
| 3,941,954 | 3/1976 | Wintringham | 70/276 X |
| 3,942,345 | 3/1976 | Sasahara | 70/276 |

*Primary Examiner*—Roy D. Frazier
*Assistant Examiner*—Rodney H. Bonck
*Attorney, Agent, or Firm*—Harris Zimmerman

[57] ABSTRACT

A magnetically operated lock includes a fixed lock body in which a plurality of fixed permanent magnets are disposed in a predetermined pattern. Aligned with each permanent magnet is a hole in which a movable magnet is slidably disposed, the movable magnet being oriented to be repelled by the fixed magnet. A lock shaft is pivotally secured through the lock body, and a rotor secured to the shaft is disposed adjacent to the openings of the holes receiving the movable magnets. The rotor includes a plurality of detents which receive the movable magnets, locking the shaft in a fixed position. The key comprises a disc having a plurality of magnets embedded therein and oriented to repel the movable magnets and free the rotor and shaft for rotation.

1 Claim, 5 Drawing Figures

MAGNETICALLY OPERATED LOCKING DEVICE AND KEY

BACKGROUND OF THE INVENTION

There is known in the prior art a great variety of locking devices which are magnetically actuated or controlled. These devices generally mimic conventional key operated tumbler locks in their design and operation, and suffer from the same drawbacks; i.e., they may be picked by burglars using only moderately sophisticated techniques, and they may be disabled by any object inserted into the key slot. Further, the magnetic locks of the prior art suffer from the same corrosion and wear problems as conventional key locks.

A further consideration is the nature of the repulsive forces between magnets. Tumblers or latches which are operated by spring force may easily be designed to travel in a desired direction without binding or sticking. When considering magnetically operated latches and tumblers, it must be noted that magnets of similar confronting polarities not only impart a repelling force to each other, but also tend to rotate so that the opposite poles may move into confrontation. Prior art magnetic lock designs which failed to allow for this characteristic behavior have suffered from high failure rates due to magnetic actuators which pivot and bind in the mechanism.

SUMMARY OF THE INVENTION

The present invention generally comprises a magnetically operated locking device which includes a cylindrical lock body, a lock shaft pivotally extending axially through the lock body, a rotor secured to the shaft adjacent to the lock body, and a key adapted to engage the outer surface of the rotor. The lock body is provided with a plurality of fixed permanent magnets spaced equally about the axis and secured in one end of the lock body. A plurality of holes is disposed within the other end of the lock body, each hole positioned in alignment with a fixed magnet. Within each hole a movable permanent magnet is slidably disposed, oriented in repelling relationship with the aligned fixed magnet. Thus the fixed magnet act to urge the movable magnet to extend out of its hole.

The rotor is disposed adjacent to the openings of the holes, and is provided with a plurality of similarly spaced detents which are adapted to receive the protruding ends of the movable magnets. In this manner the movable magnets lock the rotor in a fixed angular orientation.

The exterior surface of the rotor is provided with a recess for receiving a key. The key generally comprises a disc having a plurality of fixed permanent magnets spaced similarly to the holes in the body. In the correct key for a lock the magnets are oriented to repel each of the movable magnets in the body. The magnetic forces act through the rotor to repel the movable magnets back into their respective holes, freeing the rotor for rotation. In this manner the device of the present invention is unlocked.

It should be noted that the lock of the present invention has no tumblers which can be tampered with, and cannot be picked. Further, the lock is sealed from the elements and from tampering, giving it high reliability in harsh environments.

THE DRAWING

DESCRIPTION OF THE PREFERRED EMBODIMENT

Figure 1:
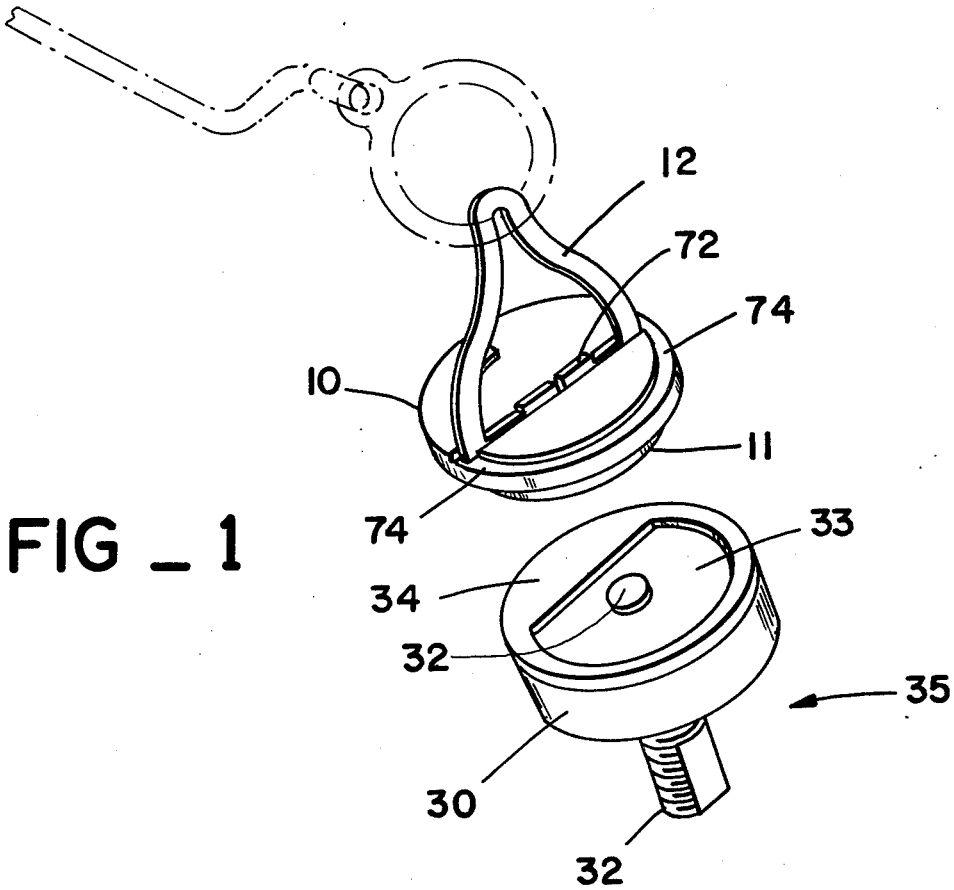
FIG. 1 is a perspective view of the lock and key of the present invention.

As shown in FIG. 1, the present invention generally comprises a lock 35 having a cylindrical lock body 30, and a key 10 provided for locking and unlocking the lock. The lock includes a rotor 31 secured to one end of the lock body by a lock shaft extending freely through the lock body and secured to the rotor. The outer surface 34 of the rotor is provided with a D-shaped recess 33, and a similarly formed D-shaped protrusion 11 extends from the key to engage the recess in torque transferring relationship. The disc-shaped key 10 is provided with a handle 12 pivotally joined to the center thereof for securing the key to a key ring or the like.

Figure 2:
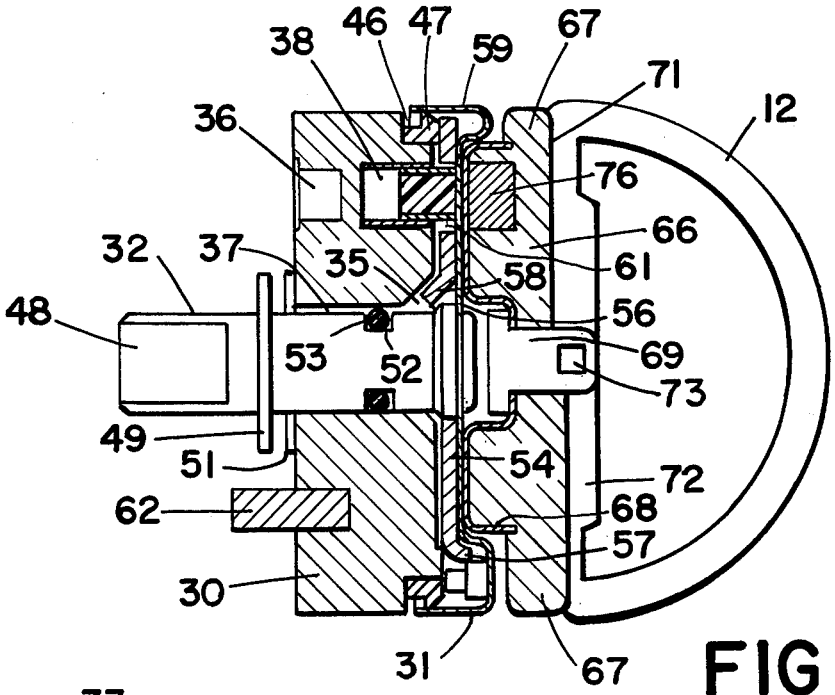
FIG. 2 is a cross-sectional elevation of the lock and key of the present invention, shown in engagement.
Figure 3:
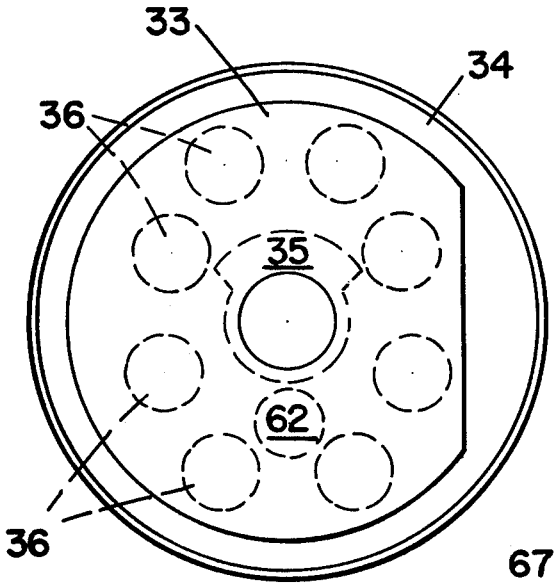
FIG. 3 is a top view of the lock of the present invention.

With reference to FIGS. 2 and 3, the lock body 30 of the present invention comprises a cylinder of molded plastic or the like in which a plurality of fixed, permanent magnets 36 are secured. The magnets 36 are spaced about the axis of the body 30, and are disposed in the interior end of the body. The body 30 is also provided with a hole 37 extending axially therethrough, the hole including at the outer end thereof a bevel 35 which extends for approximately 90°, as shown in FIG. 3.

Figure 5:
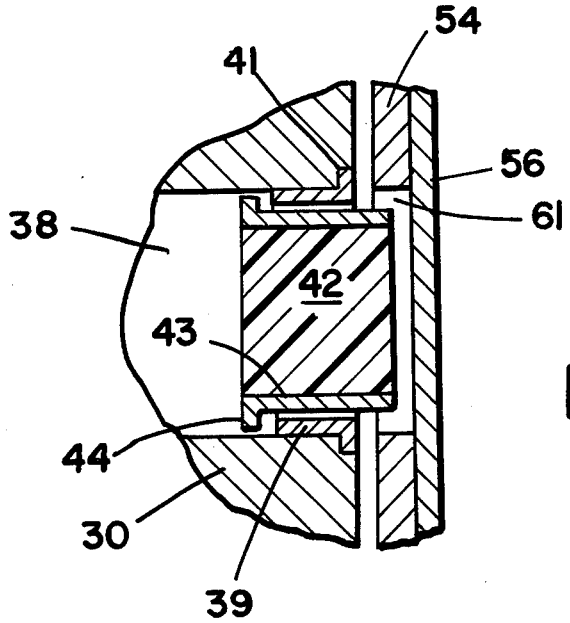
FIG. 5 is a detailed cross-sectional view of a movable magnet of the present invention.

The body 30 is also provided with a plurality of holes 38 disposed in the outer end thereof, each hole 38 being aligned with one of the magnets 36 in the other end of the body 30. As shown in FIG. 5, the outer end of the hole is lined with a sleeve 39 which has a lip 41 extending flush with the outer surface of the lock body. A magnet 42 is encased within a sleeve 43 which is freely disposed within the sleeve 39. The sleeve 43 is provided with a flange 44 extending outwardly from the inner end thereof. The flange 44 is greater in diameter than the sleeve 39, and serves to retain the magnet 42 in the hole 38. Also, the lengths of the magnet 42 and the sleeve 39 are selected so that the magnet 42 may protrude from the hole 38 a predetermined, controlled distance.

It should be noted that in the preferred embodiment all of the magnets described previously or subsequently are formed of a plastic-base magnetic material which has excellent magnetic properties and is easily machined to very high tolerances.

The outer end of the lock body is provided with a reduced diameter annulus 46, in which a gasket sealing ring 47 is retained for purposes to be described in the following. The lock shaft 32 of the present invention extends in a freely pivoting fashion through the hole 37 in the lock body. The inner end of the shaft is provided with a longitudinally extending planar portion 48 for operating the strike of a latch mechanism, a set of electrical contacts, a cam, or other devices which control entry or access. A Belleville washer is secured to the shaft directly adjacent to the lock body by a retaining ring 49 joined to the shaft 32. An O-ring groove 52 is disposed in a medial portion of the shaft, the O-ring 53 retained therein forming a seal with the interior of the hole 37.

The rotor 31 is riveted to the outer end of the shaft 32 in a predetermined orientation with respect to the planar surface 48. The rotor comprises a plate member 54 and a cover member 56 joined together as the cover member is riveted to the end of the shaft 32 through an axial hole in the plate member. The cover member includes formed peripheral portions which define the surfaces 33 and 34 shown in FIG. 1. The plate 54 is provided with a flange 57 which engages the upwardly curved portion of the cover member forming the D-surface thereof, thereby joining the cover member and plate member in fixed rotational relationship.

The plate member also includes a narrow lip 58 extending from the inner circumference of the plate member into the bevel 35, as shown in FIG. 2. The lip is limited in its rotational travel to the extent of the bevel 35, thereby limiting the rotation of the rotor to approximately 90°. It should be noted that the outer periphery 59 of the cover member is curved downwardly to engage the gasket 47 in sealing fashion. This seal, together with the O-ring 53, retain lubricant and prevent dirt and corrosive agents from entering the critical areas of the lock, such as the interface between the rotor and the lock body.

The plate member 54 includes a plurality of holes 61 extending therethrough to the cover member. The holes 61 are equal in number and spacing to the holes 38, and are adapted to receive the top portion of the magnets 42, as shown in FIG. 5. It may be appreciated that any one magnet 42 extending into its associated hole 61 will act to prevent rotation of the rotor. Further, in the absence of any countervailing force, the repelling polarities of the magnets 36 and 42 will cause the magnets 42 to be normally disposed with the upper portion thereof in the holes 61, thereby locking the rotor-lock body assembly.

The lock body must be rotationally fixed to the article, structural member, or the like to which it is secured. Toward this end the lock body is provided with a locating pin 62 extending therefrom parallel to the lock shaft. The pin 62 is received in a suitable hole in the article or structural member to prevent rotation of the entire lock assembly.

Figure 4:
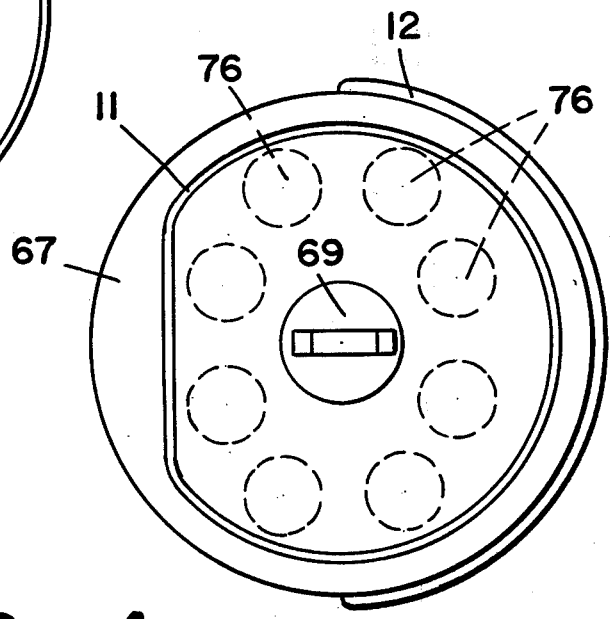
FIG. 4 is a top view of the key of the present invention.

As shown in FIGS. 2 and 4, the key of the present invention generally includes a key body 66 which comprises a disc-like member formed of high impact plastic or the like. The key body includes an outwardly extending, reduced thickness flange 67 which is the mirror image of the configuration of the surface 34 of the rotor. Joined to the central portion of the key body is a key cover 68, the key cover-key body assembly being configured to be received within the recess 33 of the rotor. The assembly is also provided with a centrally disposed countersunk hole therethrough, a broad-headed fastener 69 being received in the hole with the head thereof in the countersink.

The key is also provided with an arcuate handle 12, which is adapted to pivot flush with top surface 71 of the key. The diametrical portion 72 of the handle is pivotally received through a hole 73 in the distal portion of the fastener 69, thereby securing the handle, key body, and key cover together. The top surface 71 is provided with a groove 74 which receives the handle as it is pivoted toward the key body so that the handle may be disposed for convenience flush with the surface 71.

Secured within the key body are a plurality of fixed, permanent magnets 76, which are provided to repel the movable magnets 42 out of the holes 61 in the rotor plate member and permit the rotor and shaft to turn freely. As shown in FIG. 4, the magnets 76 of a correct key are positioned in a pattern identical to the pattern of the magnets 36, with the confronting polarities of the associated magnets 76 and the magnets 42 identical to create the necessary repelling force. If the polarity of at least one magnet 76 is wrong; i.e., opposite to the confronting magnet 42, the rotor will remain locked, as explained in the foregoing.

It may be appreciated that since only one magnet 42 is required to lock the rotor, the variations of lock configurations can include any number of magnets 42 from one to eight. Thus the number of variations equals the permutation of eight things taken at least one at a time, multiplied by two to account for the two possible polarities. It should be noted that in the preferred embodiment the magnets 36 and their aligned movable magnets 42 are disposed at different radii about the lock body, and the key magnets are disposed in a similar pattern. This pattern comprises two pair of magnets centered at the same radius, each pair symmetrically opposed to the other. With this pattern the preferred embodiment employs four movable magnets 42 and four key magnets 76. The spacing and number of magnets used is not evident from the external appearance of the present invention.

The salient features of the present invention may be summarized as follows:

The lock has no external openings and is sealed to prevent contamination by dirt and corrosive agents. It therefor has excellent resistance to wear and environmental factors.

The lock cannot be picked by using conventional techniques, nor can the proper combination be detected by listening for the tumblers to fall, nor can the pattern or spacing of the magnets be determined.

The compact key design, which permits the key to be stored as easily as a coin, is far more convenient than conventional keys.

I claim:

1. A lock assembly, comprising a generally cylindrical lock body, a lock shaft extending through said lock body coaxially in freely rotating fashion and extending beyond one face of said body, a plurality of fixed magnets disposed within said body and oriented parallel to the axis thereof, a plurality of holes disposed in said body and opening to the other face of said body, each of said holes aligned with one of said fixed magnets, the outer portion of each of said holes including a sleeve extending flush with said outer face, a plurality of movable magnets, each translatably disposed within one of said holes and operatively associated with the respectively aligned fixed magnet, each of said movable magnets including a jacket thereabout, each jacket including a flange extending from the inner end thereof and adapted to engage the inner end of said sleeve of the respective hole to limit extension of said magnet from said hole, a disc-like rotor secured to said shaft adjacent to said other face of said body, detent means on said rotor for engaging at least one of said movable magnets as it extends from its associated hole, and key means for disengaging said movable magnets and said detent means and rotating said rotor.

* * * * *